US006804920B2

(12) United States Patent
Hogan

(10) Patent No.: US 6,804,920 B2
(45) Date of Patent: Oct. 19, 2004

(54) TUBE-LOCK CURTAIN WALL SYSTEM

(75) Inventor: Jerry C. Hogan, Pelham, AL (US)

(73) Assignee: X-Clad, Inc., Pelham, AL (US)

( * ) Notice: Subject to any disclaimer, the term of this patent is extended or adjusted under 35 U.S.C. 154(b) by 93 days.

(21) Appl. No.: 10/161,735

(22) Filed: Jun. 5, 2002

(65) Prior Publication Data

US 2003/0226324 A1 Dec. 11, 2003

(51) Int. Cl.[7] ..... E04H 1/00

(52) U.S. Cl. ..... 52/235; 52/204.5; 52/204.6; 52/208; 52/209; 52/204.57; 52/204.593; 52/204.62; 52/220; 52/171; 52/173; 52/399; 52/400; 52/775; 52/764

(58) Field of Search ..... 52/204.57, 204.593, 52/204.62, 235, 775, 764, 399, 173, 171, 220, 209, 302, 204.5, 204.6, 400, 483.1, 208

(56) References Cited

U.S. PATENT DOCUMENTS

| | | | | | |
|---|---|---|---|---|---|
| 3,266,210 | A | | 8/1966 | Grossman | |
| 4,448,001 | A | * | 5/1984 | Whitmyer et al. | 52/209 |
| 4,608,793 | A | * | 9/1986 | Yost et al. | 52/235 |
| 4,621,478 | A | * | 11/1986 | Phillips et al. | 52/775 |
| 4,756,132 | A | | 7/1988 | Newman et al. | |
| 4,977,716 | A | | 12/1990 | Hawkins | |
| 4,981,001 | A | | 1/1991 | Furuminato | |
| 5,067,293 | A | | 11/1991 | Reynolds | |
| 5,253,459 | A | * | 10/1993 | Parinas et al. | 52/235 |
| 5,309,689 | A | * | 5/1994 | Croissant | 52/235 |
| 5,481,839 | A | * | 1/1996 | Lang et al. | 52/235 |
| 5,592,795 | A | * | 1/1997 | Rinehart et al. | 52/235 |
| 5,619,834 | A | | 4/1997 | Chen | |
| 5,632,125 | A | | 5/1997 | Osanai | |
| 5,839,236 | A | * | 11/1998 | Frey | 52/235 |
| 6,032,423 | A | * | 3/2000 | Takemura et al. | 52/235 |
| 6,141,923 | A | * | 11/2000 | Habicht et al. | 52/235 |
| 6,158,182 | A | * | 12/2000 | Biebuyck | 52/235 |
| 6,202,382 | B1 | * | 3/2001 | Conterno | 52/762 |
| 6,205,724 | B1 | | 3/2001 | Garling et al. | |
| 6,269,600 | B1 | | 8/2001 | Tambakakis | |
| 2001/0011444 | A1 | | 8/2001 | Kenny et al. | |

* cited by examiner

*Primary Examiner*—Carl D. Friedman
*Assistant Examiner*—Christy M. Green
(74) *Attorney, Agent, or Firm*—Dykema Gossett PLLC

(57) ABSTRACT

A curtain wall including a plurality of mullions each having a pair of glazing pockets, an I-section for supporting an interior trim member and protrusions for supporting an exterior trim member. The curtain wall further includes a plurality of rails including a notched section for insertion into the mullion glazing pockets, and a plurality of protrusions for supporting interior and exterior trim members. A bead having a plurality of protrusions is connected to the mullion in a lengthwise direction thereof, and supports the interior trim member. A plurality of retainers are insertable into notches in the mullions, the beads or the rails for removably retaining glazing infill components (i.e. panels, windows, doors) in the curtain wall. The curtain wall design of the present invention allows for the glazing infill components to be installed and/or removed from either the front side or the back side of the curtain wall.

37 Claims, 16 Drawing Sheets

FIG. 1
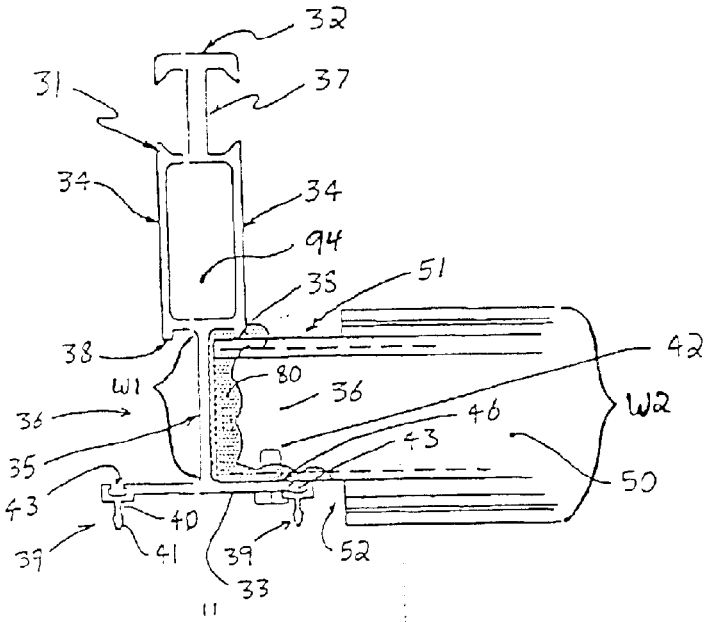
FIG. 3
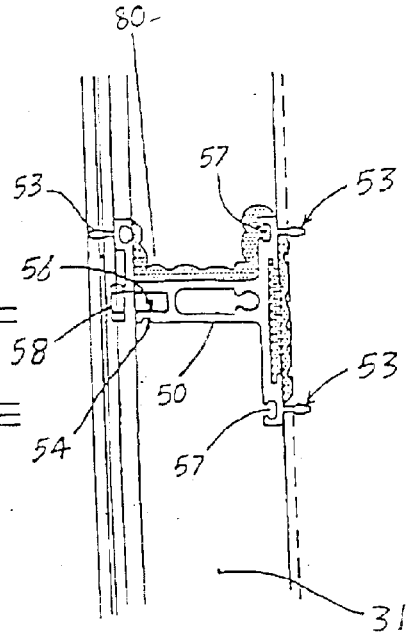
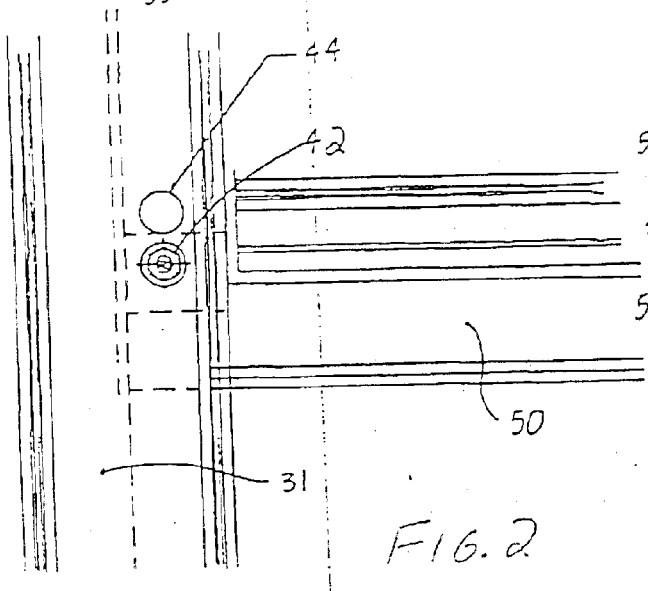
FIG. 2

31
110
60
30
110
90
91
92
50
100
261
93
70
100

TUBE-LOCK CURTAIN WALL SYSTEM

BACKGROUND OF INVENTION a. Field of Invention

The invention relates generally to a wall framing structure, and, more particularly to a tube-lock curtain wall, which includes a plurality of framing components which may be interconnected to adapt the curtain wall to a variety of building structures, and incorporate therein a variety of building components such as windows, doors, panels and the like.

b. Description of Related Art

A need exists for an improved curtain wall system, that may be easily and economically manufactured, and that includes an improved frame network for ease of assembly and disassembly thereof, and for ease of installation.

Curtain walls are well known in the art, and may be used instead of a traditional brick wall, for example, as exterior or interior walls in a building. Curtain walls generally include a plurality of vertical mullions anchored to the building structure, and a plurality of horizontally oriented rails interconnected therebetween to provide structural rigidity. The mullions and rails may be configured to support a variety of doors, panels, windows and the like.

In the past, conventional curtain wall designs have been relatively complex, have generally included multiple components, have had limited flexibility in terms of the variety of components that may be infilled in the curtain wall framework, and have thus required relatively complicated manufacturing and assembly techniques. Conventional curtain wall designs also include flaws such as inadequate insulation, lack of structural rigidity and other drawbacks related to the aesthetic appearance thereof. In conventional curtain walls, one such particular drawback relates to the installation procedure for glazing infill components, such as panels, doors, windows and the like, which have thus far been installable or replaceable only from one side of the curtain wall.

From a manufacturing standpoint, the manufacture of complex curtain wall designs of the past has resulted in a significant increase in the overall manufacturing cost of the frame components, which may be manufactured by the thousands. From an assembly standpoint, the assembly and installation of complex curtain wall designs can be time-consuming and burdensome, and can add significantly to the overall cost for a building. Lastly, from a maintenance and use standpoint, conventional curtain wall designs have failed to provide a level of durability generally associated with a conventional brick or concrete wall.

In the art, there currently exist various conventional wall designs, as disclosed for example in U.S. Pat. Nos. 3,266,210, 4,448,001, 4,608,793, 4,621,478, 4,756,132, 4,977,716, 4,981,001, 5,067,293, 5,253,459, 5,309,689, 5,481,839, 5,592,795, 5,619,834, 5,632,125, 5,839,236, 6,032,423, 6,141,923, 6,158,182, 6,202,382, 6,205,724, 6,269,600 and U.S. patent Publication No. 2001/0011444 A1. The wall designs disclosed therein include basic frame components such as mullions, rails, anchors and the like.

These conventional wall designs however have several of the same drawbacks and disadvantages of the conventional curtain wall design described above. Some of the key drawbacks generally include an excessive number of components for providing structural rigidity, which can render the curtain wall framework difficult and expensive to manufacture. Additionally, the excessive number of components can make the assembly, installation, maintenance and use of the conventional curtain wall design burdensome, thus favoring the use of standard brick or masonry wall units.

SUMMARY OF INVENTION

The invention solves the problems and overcomes the drawbacks and disadvantages of the prior art by providing a curtain wall, which includes fewer components for ease of manufacture and assembly, and yet is structurally and functionally superior to conventional curtain walls.

Thus, an aspect of the present invention is to provide a curtain wall in which glazing infill components, such as panels, doors, windows and the like, are installable or replaceable from either side of the curtain wall.

Another aspect of the present invention is to avoid the need for accessory items such as joint plugs, end plates or water diverters, which are used for diverting water in most current designs and are prone to failure.

Yet another aspect of the present invention is to provide a curtain wall in which the various components are adjustable during or after assembly, and may be used in the interior or exterior of a building, for example.

Specifically, the present invention provides a curtain wall having a front side and a back side and including a plurality of mullions having mullion glazing pockets, an I-section for supporting a first trim member and protrusions for supporting a second trim member. The curtain wall further includes a plurality of first rails having a width W2 greater than the width W1 of the mullion glazing pockets, having notches for insertion into the mullion glazing pocket and protrusions for supporting third and fourth trim members. A plurality of beads each having a protrusion thereon are connected to the mullions in a lengthwise direction thereof and support the first trim member. A first retainer for removably retaining a glazing infill component against a mullion is insertable into a notch in the mullion. A second retainer for removably retaining the glazing infill component against a bead is insertable into a notch in the bead. This curtain wall design allows for a glazing infill component to be installed from either the front side or the back side of the curtain wall.

The present invention further provides a curtain wall in which the mullion glazing pockets, the I-section, and notches and protrusions on the mullion extend substantially along a length of the mullion. The protrusions on the first rail extend substantially along a length of the first rail. Likewise, the notch and protrusion on the bead extend substantially along a length of the bead. The curtain wall further includes a seal for sealing an area between edges of the first rail substantially adjacent the mullion. A retention member is disposed on a protrusion on the mullion, the rail or the bead. A third retainer is provided for removably retaining the glazing infill component against the first rail, and is insertable into a notch in the first rail. The curtain wall yet further includes another bead connected to the first rail, in a lengthwise direction thereof, and having a protrusion for supporting the fourth trim member. Anchors may be adjustably mounted along a length of the mullion for removably attaching the curtain wall to a building wall. A second rail having a protrusion and a catch engageable with the ridge on the mullion is also provided. Lastly, the curtain wall includes adapters having a protrusion and a notch, each extending along a length thereof. The protrusion on the adapter is insertable into the notch in the first rail.

The present invention yet further provides a curtain wall including first corner-rails having protrusions for supporting a fifth trim member, notches for insertion of a fourth retainer and an angled retainer. Second corner-rails having a complementary angled retainer for engaging the angled retainer on the first corner-rail, protrusions for supporting a sixth trim member, a notch for insertion of a protrusion on an adapter having a protrusion and a notch, and extensions, are also provided. The curtain wall yet further includes third corner-rails including complementary extensions for engagement with the extensions on the second corner-rails, and protrusions for supporting the sixth trim member.

The present invention also includes a method of installing a curtain wall having a front side and a back side, including the step of connecting mullions to first rails. The mullions include glazing pockets, an I-section for supporting a first trim member and protrusions for supporting a second trim member. The first rails have a width greater than a width of the glazing pockets and include notches for insertion of the first rails into the glazing pockets and protrusions for supporting third and fourth trim members by fasteners. The method further includes the step of connecting beads to the mullions, in a lengthwise direction thereof, by fasteners, and attaching the curtain wall to a building by anchors. Thereafter, first retainers may be inserted into a notch in a mullion to retain a glazing infill component against the mullion, and second retainers may be inserted into a notch in a bead to retain the glazing infill component against the bead. The method of installing the curtain wall according to the present invention allows for the glazing infill components to be installed from either the front side or the back side of the curtain wall.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings:

FIG. 1 is a sectional top view of a first embodiment of a mullion, a rail and a seal according to the present invention, illustrating an assembled configuration;

FIG. 2 is front view of the mullion and rail of FIG. 1, illustrating an assembled configuration;

FIG. 3 is sectional side view of the mullion, the rail and the seal of FIG. 1, illustrating an assembled configuration;

DETAILED DESCRIPTION OF THE PREFERRED EMBODIMENT

Figure 6:
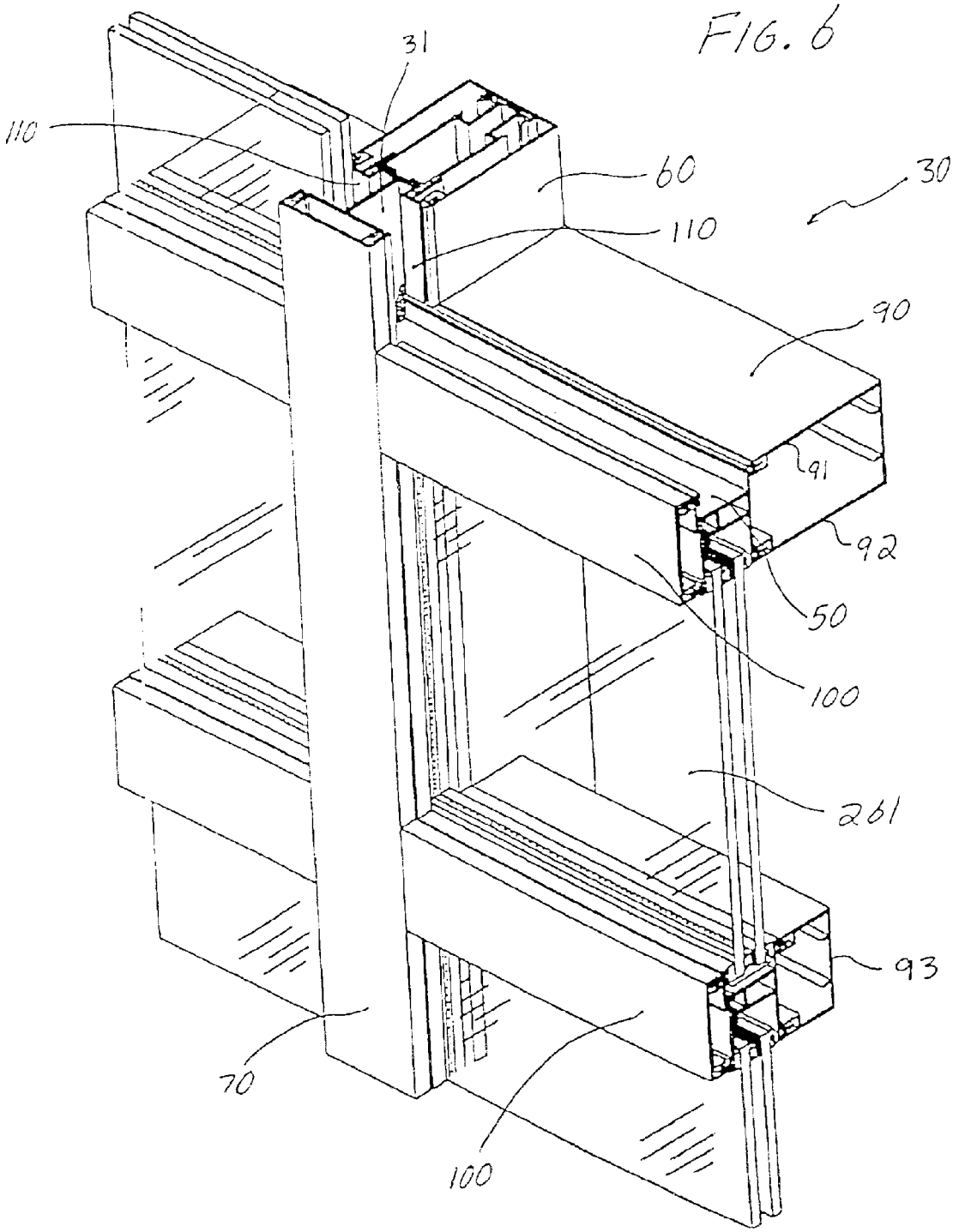
FIG. 6 is a perspective view of a curtain wall according to the present invention, including the mullion and rail of FIG. 1, and further illustrating various trim and panel members that may be used in the curtain wall.
Figure 8:
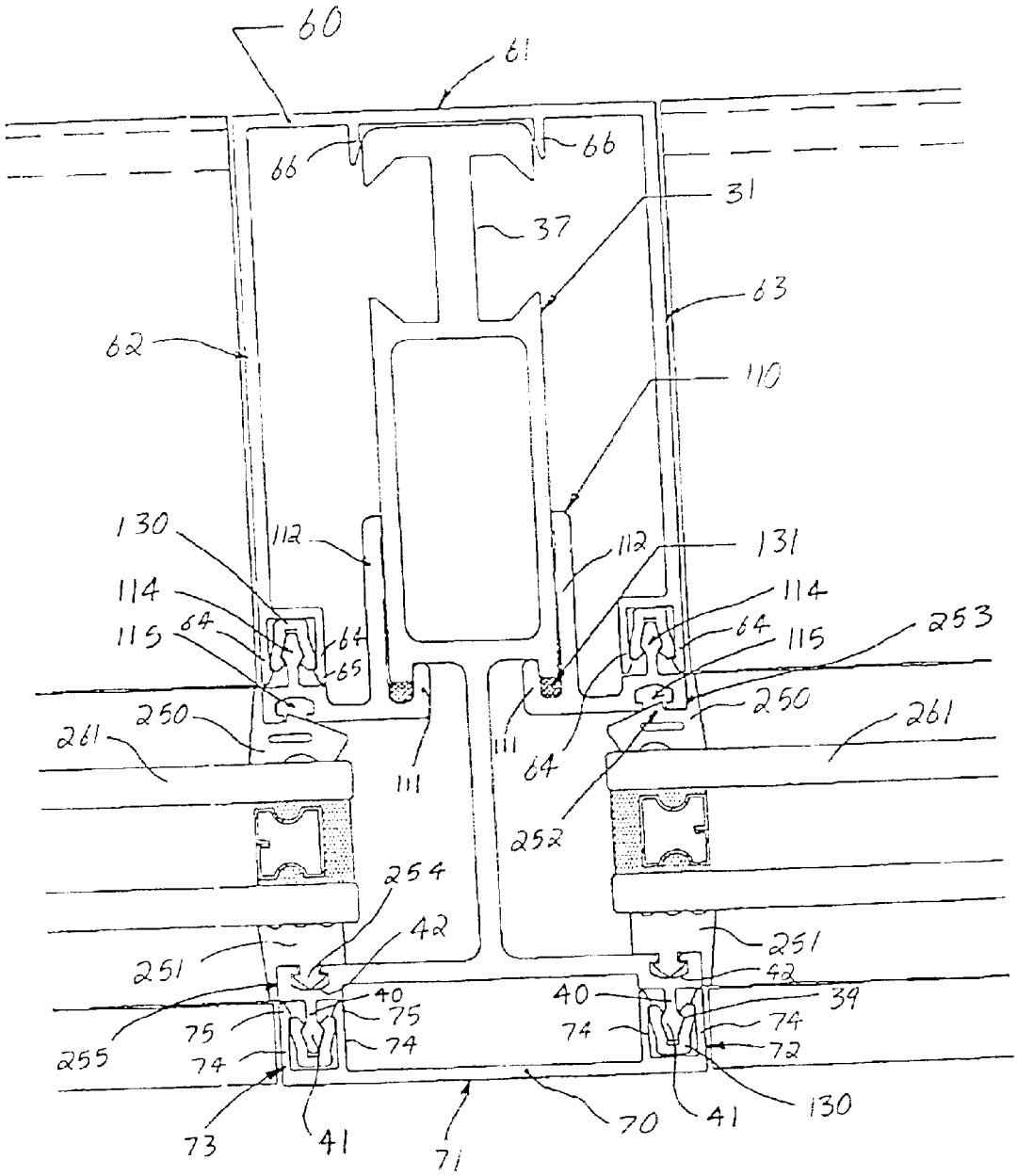
FIG. 8 is a sectional top view of the mullion and rail of FIG. 1, illustrating panels and trim members attached thereto.

As shown in FIGS. 1 and 6, a curtain wall according to the present invention, generally designated 30, may include a mullion 31. Mullion 31 may include a front wall 32, back wall 33, side walls 34, base portion 35, and hollow section 94. Base portion 35 may include a pair of mirror-image mullion glazing pockets 36. Mullion 31 may further include an I-section 37 and ridges 38, for connection of interior trim 60 thereto. This tubular I-beam construction provides the bending resistance of an I-Beam with the improved torsional buckling properties of a tube. A plurality of protrusions 39 may be provided for connection of exterior trim 70. Each protrusion 39 may extend substantially along the entire length of mullion 31. Moreover, as shown in FIG. 8, each protrusion 39 may include a narrow shaft section 40 and an enlarged head section 41, to permit engagement of a retention member 130, described below. At least one hole 46 may be provided on mullion 31 for insertion of a conventional screw 42 for mounting rail 50. Moreover at least one notch 43 may be provided for insertion of retainers 250 or 251, for frictionally retaining, for example, a panel 261, as described below.

As shown next in FIG. 2, mullion 31 may include a weep hole 44 to facilitate the passage of any water that may enter into mullion glazing pockets 36. Although one weep hole 44 is shown in FIG. 2, it should be apparent that a plurality of weep holes, or no weep holes may be provided on mullion 31.

Figure 4:
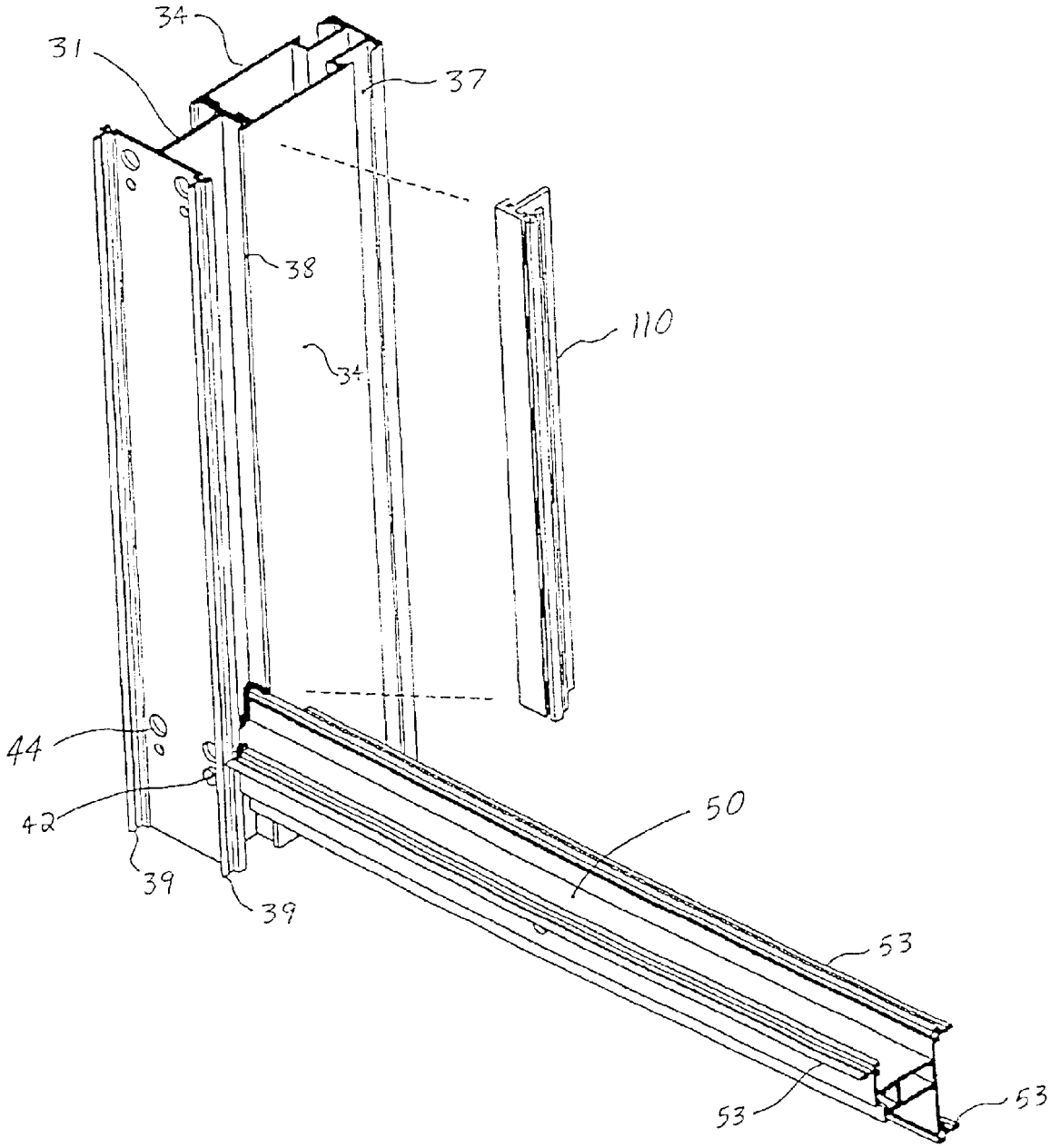
FIG. 4 is a combined exploded and assembled perspective view of the mullion and rail assembly of FIG. 1, and a bead, illustrating the bead in a disassembled configuration.
Figure 12:
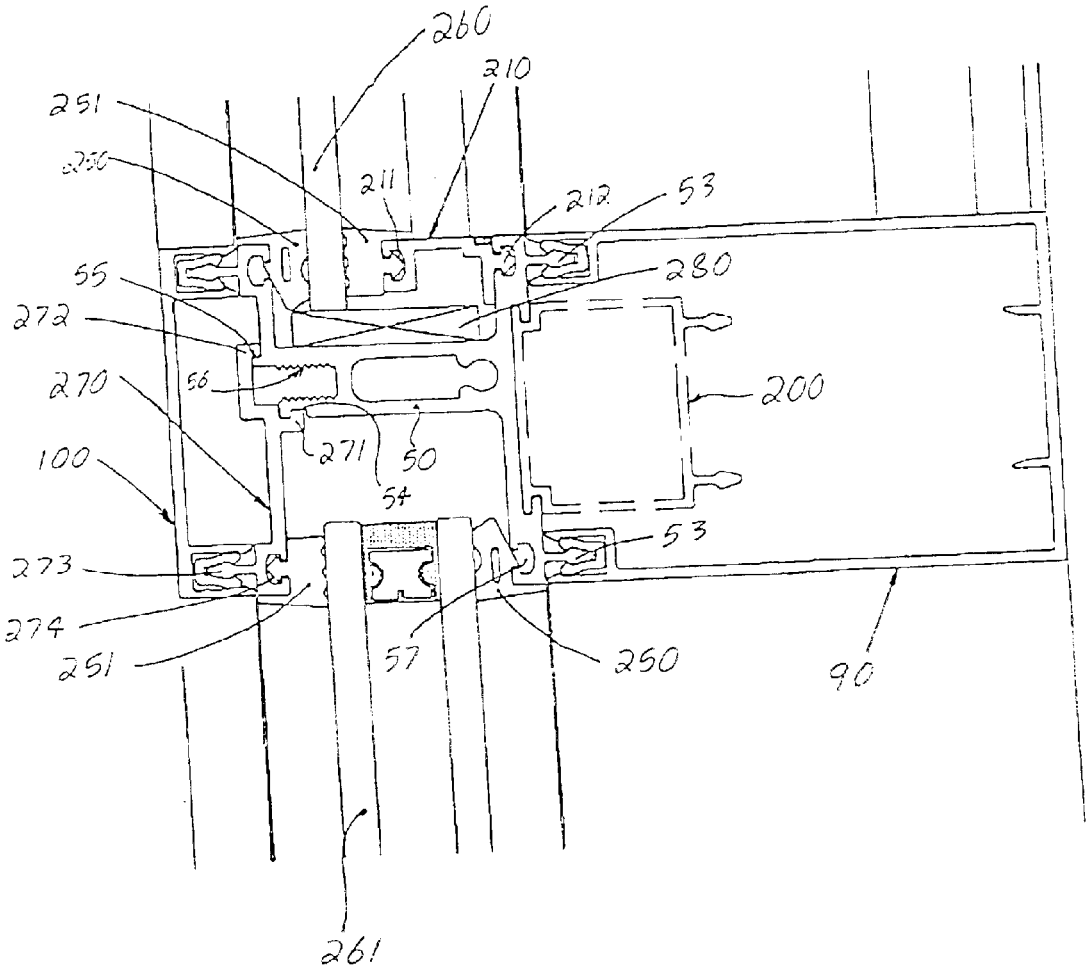
FIG. 12 is a sectional top view of an exemplary center-most section of a curtain wall, illustrating panels of different thickness and the components in an assembled configuration.

Referring to FIGS. 1 and 12, rail 50 may be received in one of the mullion glazing pockets 36 and attached to mullion 31 by screw 42, for example. Rail 50 may have a cross-sectional width greater than that of the mullion glazing pockets 36, and therefore may include first and second notches 51 and 52, respectively, to facilitate assembly thereof into one of the mullion glazing pockets 36. Protrusions 53 may be provided for mounting interior and exterior trim 90 and 100, respectively, on rail 50. Each protrusion 53 may extend substantially along the entire length of rail 50. Rail 50 may further include a catch 54 and abutment surface 55, for engagement with bead 270, described below. A threaded section 56, extending substantially along the length of rail 50, may also be provided on rail 50 for fastening bead 270 to rail 50 by a screw 58. As shown in FIGS. 2 and 4, it should be evident that rail 50 may be placed anywhere along the length of mullion 31 and attached to mullion 31 by screw 58. Referring to FIG. 12, notches 57 may be provided on rail 50 so as to provide an insertion area for retainers 250 or 251, or protrusion 212 on adapter 210 (described below), for retaining, for example, panels 260 and 261.

As shown in FIGS. 1 and 3, a seal 80 may be provided to seal any gaps between the interconnection between rail 50 and mullion 31, and may extend in the vertical and horizontal directions of the interior surface of mullion 31. Seal 80 may be a conventional seal made of rubber, or other such equivalent material, as would be apparent to a skilled artisan.

Referring to FIGS. 4, 6, 8 and 16, two mirror-image beads 110 may be provided adjacent each side wall 34 of mullion 31 to facilitate assembly of interior trim 60 on mullion 31. Each bead 110 may include a catch 111 and an extension 112 to engage ridge 38 and side wall 34, respectively, of mullion 31. Each bead 110 may further include a protrusion 114, extending substantially along the entire length thereof, for connection of interior trim 60 on mullion 31. A plurality of screws 113 may be spaced along the length of bead 110 to attach bead 110 to mullion 31. Lastly, each bead 110 may also include a notch 115 for engagement with and insertion of retainers 250 or 251.

Figure 5:
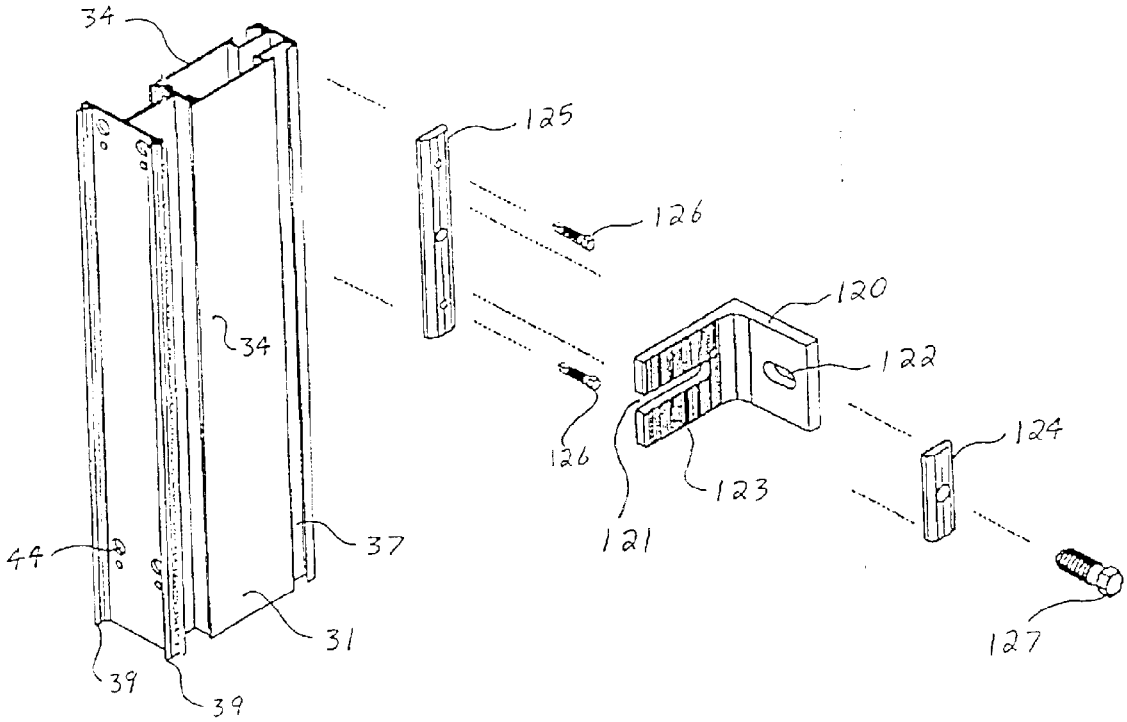
FIG. 5 is an exploded perspective view of the mullion of FIG. 1 and an anchor, illustrating the components of the anchor in a disassembled configuration.

Referring to FIG. 5, mullion 31 may be anchored onto the structure of a building by anchor 120. Anchor 120 may include a open slot 121, and a closed slot 122 for permitting fastening thereof onto a building structure, for example, by a nut-bolt assembly 128 (shown in FIG. 16) or other such means. Anchor 120 may further include ridges 123 to permit secure mating thereof with a first guide 124. A slidable second guide 125, which may be inserted into passageway 45 of mullion 31, may be provided so as to permit anchor 120 to be attached to mullion 31 at any location along the length thereof. Second guide 125 may be releasably mounted in passageway 45 by screws 126. Lastly, a bolt 127 may be used to releasably mount anchor 120 onto mullion 31, with first guide 124 disposed between bolt 127 and anchor 120.

For the anchor configuration described above, it should be apparent that the above-described mounting means provides for adjustment in all three axial directions and requires no preparation of mullion 31. The above-described anchor configuration also provides restraint against in/out movement of the curtain wall due to, for example, windload, while still allowing the system to freely expand or contract as necessary.

Interior and exterior trim 60, 90 and 70, 100, respectively, will now be described in detail.

As shown in FIGS. 6 and 8, interior trim 60 may include flat surfaces 61, 62 and 63, and mirror-image engagement sections 64. Alternatively, interior trim 60 may include curved, notched, or other such surfaces, as would be apparent to a skilled artisan. Engagement sections 64 may include mirror-image retention tongues 65 for retention of interior trim 60 against retention member 130. Furthermore, extensions 66 may be provided to orient and retain interior trim 60 against the top edges of I-section 37 on mullion 31.

Similar to interior trim 60, exterior trim 70 may include flat surfaces 71, 72 and 73, and mirror-image engagement sections 74. Exterior trim 70 may also include curved, notched, or other such surfaces, as would be apparent to a skilled artisan. Engagement sections 74 may include mirror-image retention tongues 75 for retention of exterior trim 70 against retention member 130.

As shown in FIG. 6, interior and exterior trim 90 and 100 may be manufactured identically to interior and exterior trim 60 and 70, respectively. Alternatively, it should be evident that surfaces 91 and 92 of interior trim 90 may be manufactured smaller in length than surfaces 62 and 63, respectively, of equivalent interior trim 60. Thus, interior trim 93, and other such equivalent trim of smaller or larger lengths could be mounted on rail 50 or mullion 31 to provide a curtain wall having a variety of trim configurations.

Figure 9:
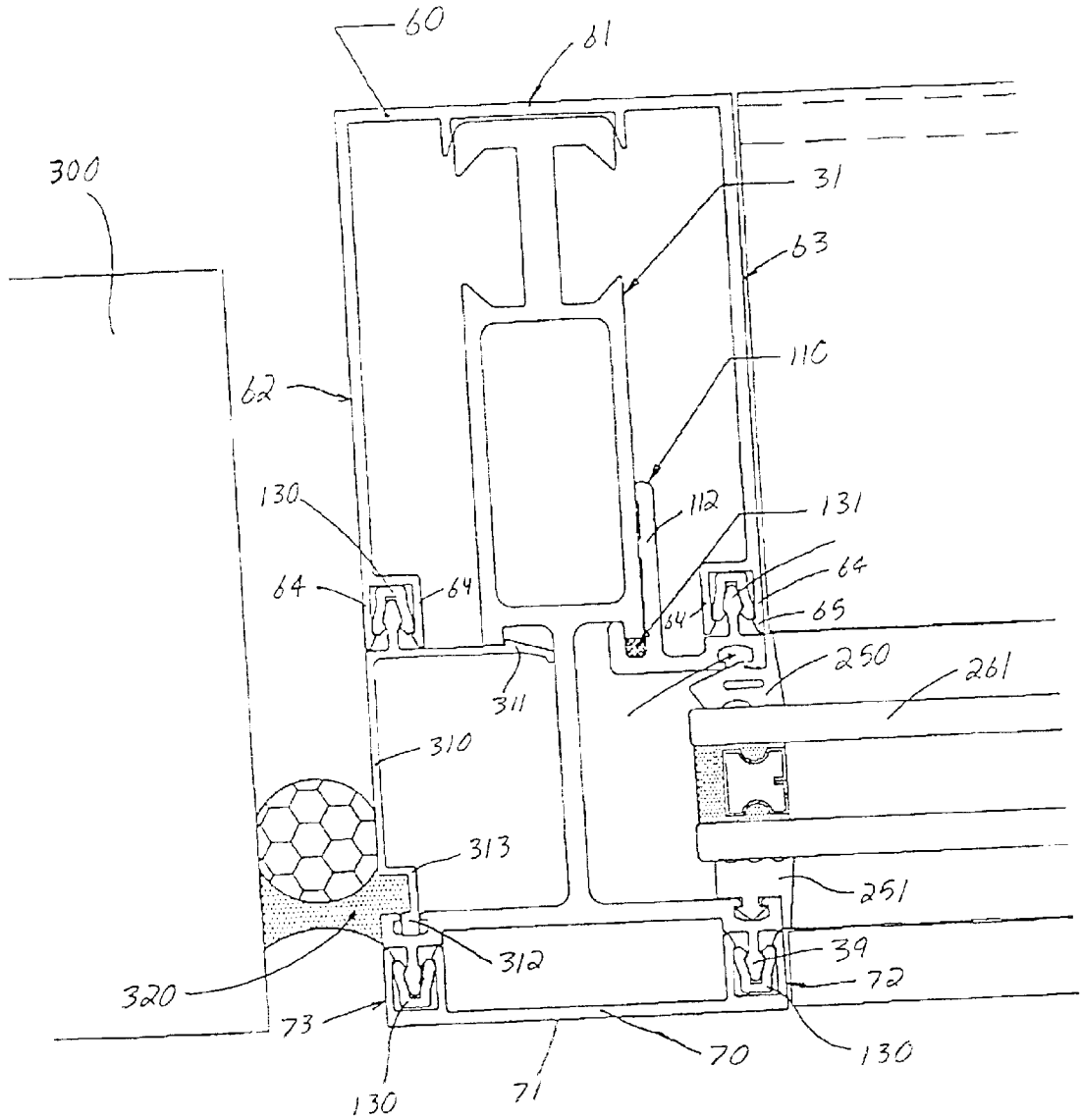
FIG. 9 is a sectional top view of the mullion and rail of FIG. 1, further including a second rail by a wall, illustrating assembly of the mullion by a wall.

Next, as shown in FIG. 8, exterior trim 70 may be snap-fitted onto mullion 31, by resilient retention members 130 disposed on protrusions 39 of mullion 31. Likewise, any of the other trim members for curtain wall 30 may be snap-fitted onto a protrusion having a resilient retention member 130 disposed thereon. Retention member 130 may be made of a plastic, ceramic, metallic, or other such equivalent materials. As shown in FIGS. 8 and 9, rod gasket air seals 131 may also be provided to seal any gaps between beads 110 and ridges 38 of mullion 31.

Alternate embodiments of mullion 31, and interior and exterior trim 60 and 70, respectively, will next be described in detail.

Figure 10:
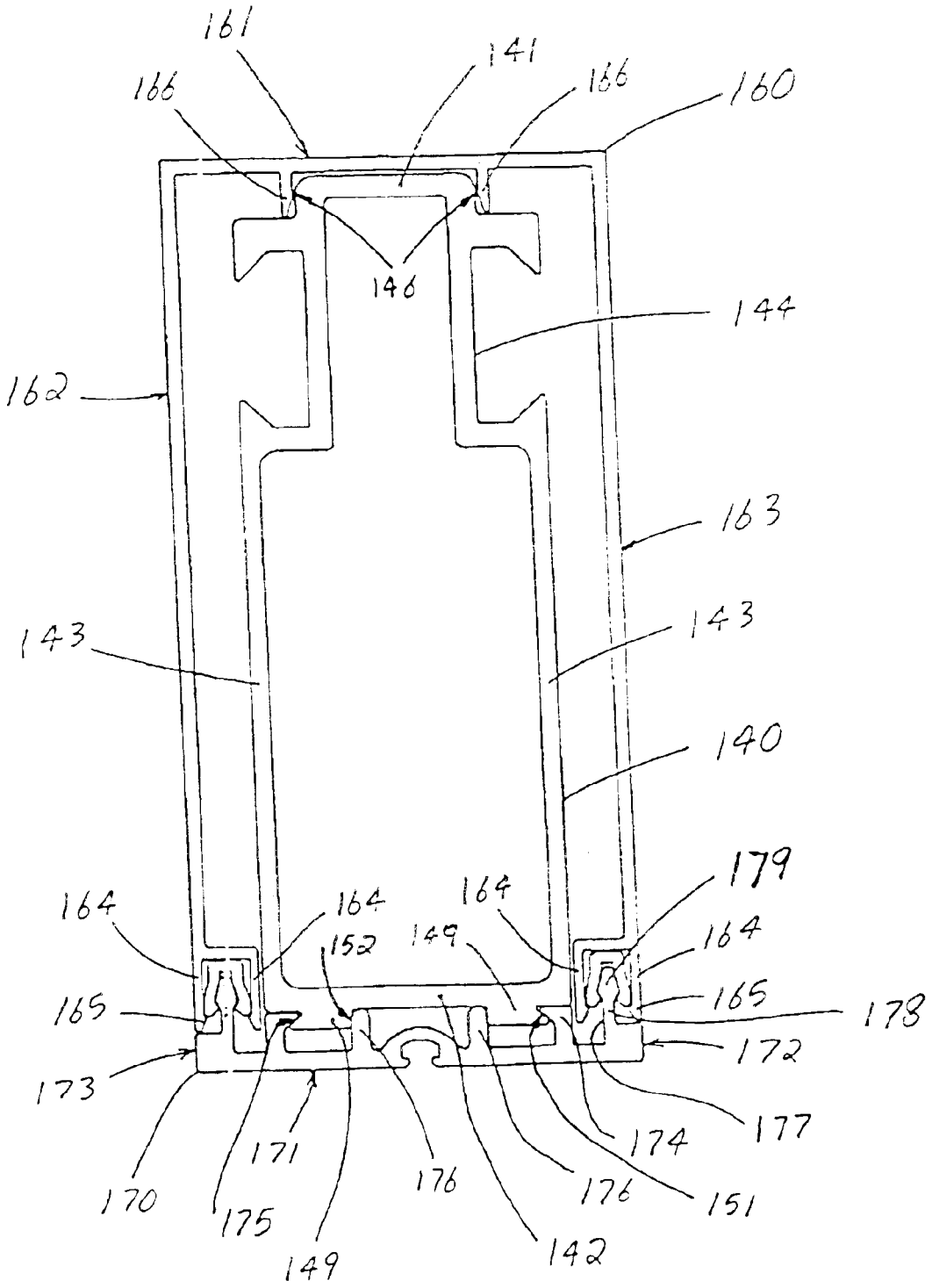
FIG. 10 is a sectional top view of a second embodiment of a mullion and trim attached thereto, illustrating the components in an assembled configuration.

Referring to FIG. 10, in an alternate embodiment of mullion 31, a mullion 140 including a front wall 141, back wall 142 and side walls 143, may be used as a stand-alone column, without any rails attached thereto. Mullion 140 may further include an I-section 144, for connection of trim 150. I-section 144 may include engagement portions 146 for contiguous engagement with extensions 166 of interior trim 160, as described below. Mullion 140 may further include mirror-image engagement members 149 for engagement with and retention of exterior trim 170, described below. Each engagement member 149 may include an angled surface 151 and a flat surface 152 for retention of exterior trim 170.

Interior trim 160 may include flat surfaces 161, 162 and 163, and mirror-image engagement sections 164. Alternatively, interior trim 160 may include curved, notched, or other such surfaces, as would be apparent to a skilled artisan. Engagement sections 164 may include mirror-image retention tongues 165 for retention of interior trim 160 against retention member 130. Furthermore, mirror-image extensions 166 may be provided so as to orient and retain interior trim 160 against the top edges 146 of I-section 144 on mullion 140.

Similar to interior trim 160, exterior trim 170 may include flat surfaces 171, 172 and 173, and mirror-image engagement sections 174. Exterior trim 170 may also include curved, notched, or other such surfaces, as would be apparent to a skilled artisan. Engagement sections 174 may include mirror-image retention tongues 175 for retention of trim exterior 170 against mullion 140. Exterior trim 170 may also include identical extensions 176 for contiguous engagement with flat surface 152 on mullion 140. A plurality of protrusions 177 extending substantially along the entire length of exterior trim 170 may be provided on exterior trim 170 for engagement with interior trim 160. Each protrusion 177 may include a narrow shaft section 178 and an enlarged head section 179, similar to protrusion 39 on mullion 31.

Figure 7:
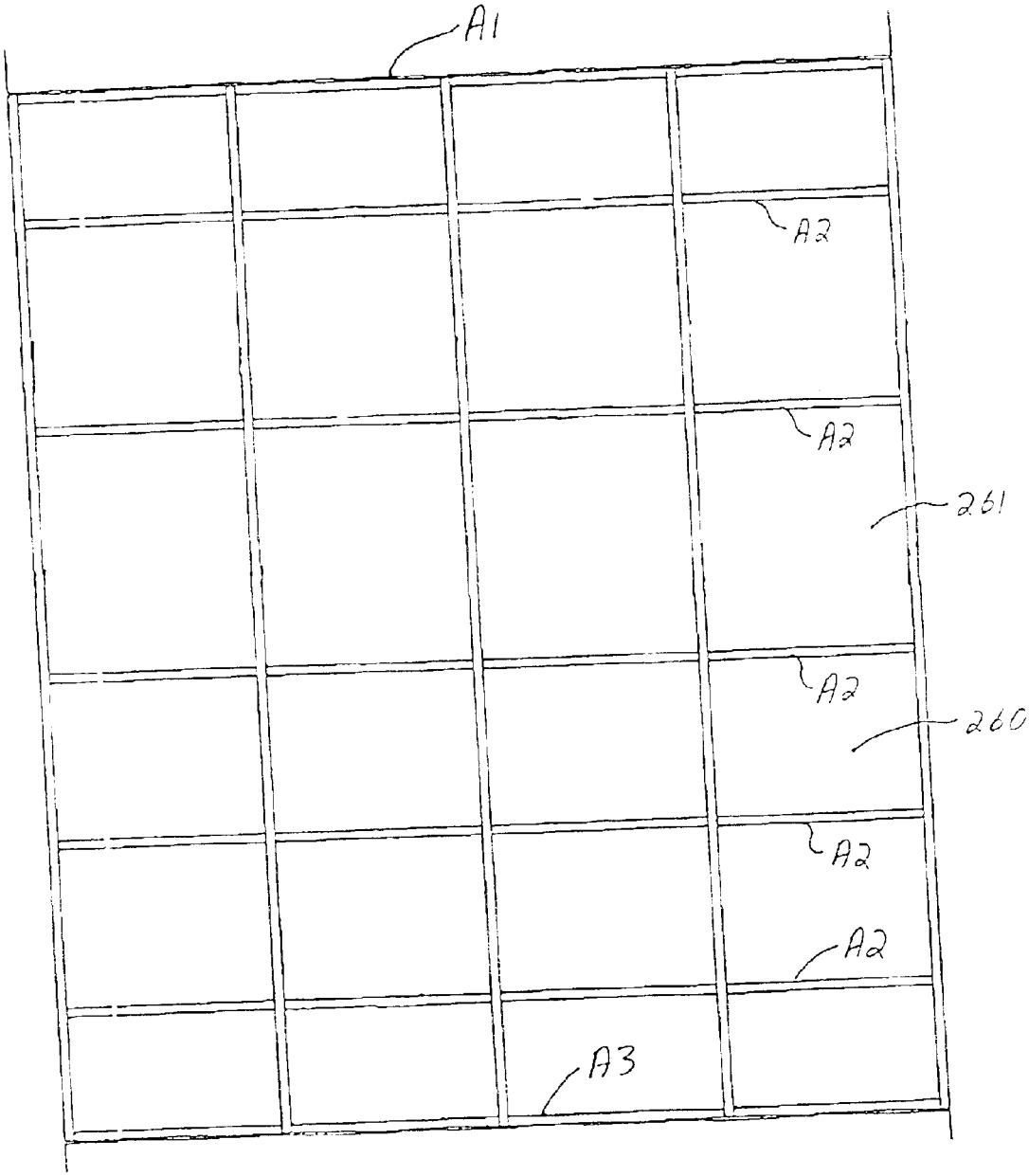
FIG. 7 is an illustrative front view of the curtain wall, illustrating a curtain wall including panels of various sizes.
Figure 11:
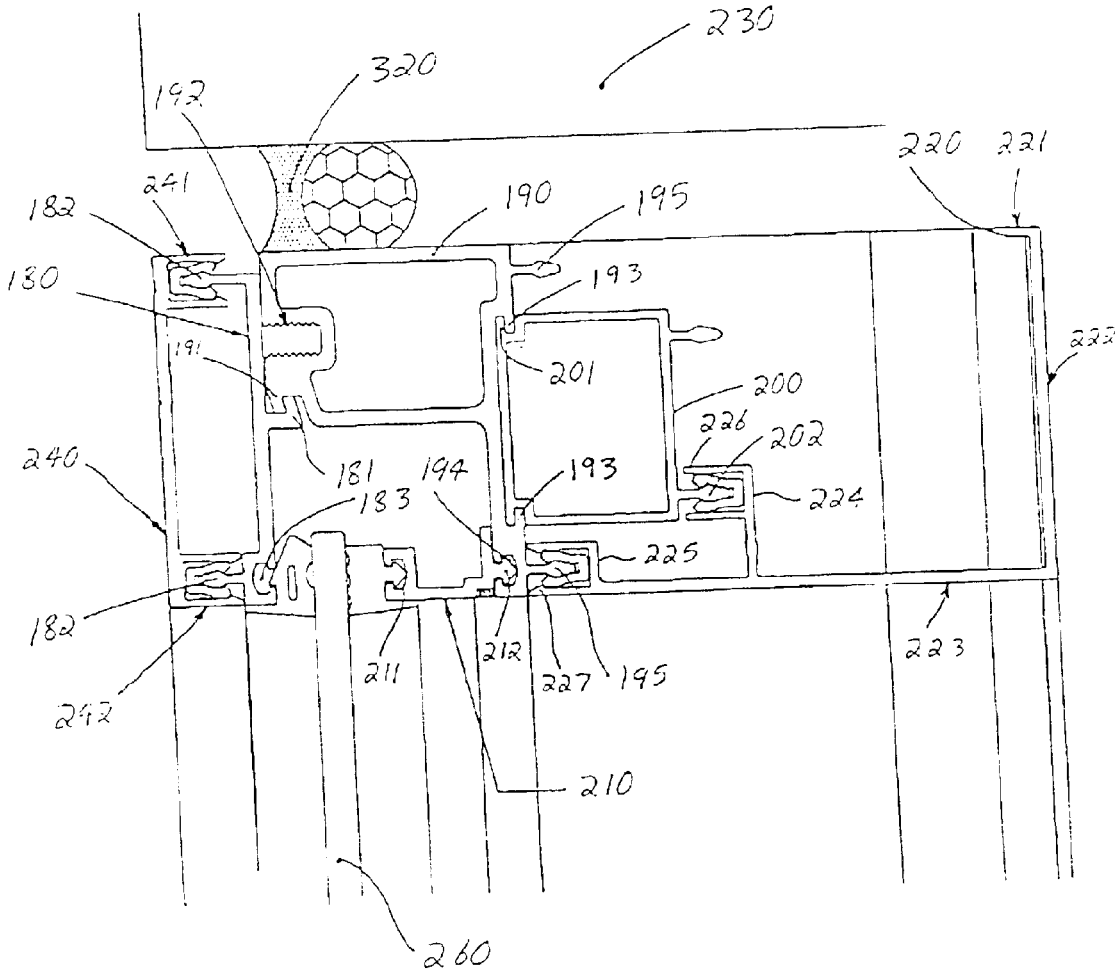
FIG. 11 is a sectional top view of an exemplary top-most section of a curtain wall, illustrating the components in an assembled configuration.

Referring next to FIG. 11, the top-most section of curtain wall 30 will now be described in detail. For the following description, top-most section of curtain wall 30 generally refers to location A1 in the illustrative curtain wall shown in FIG. 7.

The top-most section of curtain wall 30 may include first corner-rail 180 including angled retainer 181, protrusions 182, and notch 183, each extending substantially along the length thereof. Protrusions 182 may be identical to protrusions 39, described above for mullion 31.

A second corner-rail 190 may be provided for engaging first-top rail 180, and may include complementary angled retainer 191. Second corner-rail 190 may further include threaded section 192 for fastening first corner-rail 180 thereto by a screw (not shown), in a similar manner as shown in FIG. 3 for screw 58. A pair of extensions 193, extending along the length of second corner-rail 190, may be provided for facilitating connection of second corner-rail 190 with a third corner-rail 200 (described below). Second corner-rail 190 may further include notch 194 for mounting thereof with an adapter 210 (described below). Protrusions 195, identical to protrusions 39, described above, may also be provided extending substantially along the length of second corner-rail 190 for retention of interior trim 220. Referring to FIG. 11, it should be noted that the bottom protrusion 195 will be used for the top-most section of curtain wall 30, while the top protrusion 195 will be used for the bottom-most section of curtain wall 30, as described below.

A third corner-rail 200 may be provided for engaging second corner-rail 190 and retaining interior trim 220 thereon. Third corner-rail 200 may include complementary extensions 201 for retention thereof against second corner-rail 190. Moreover, protrusions 202, identical to protrusions 39, described above, may also be provided substantially along the length of third corner-rail 200 for retention of interior trim 220. It should be noted that as shown for example in FIG. 12, third corner-rail 200 may optionally be used with rail 50 for providing structural rigidity for the frame of curtain wall 30, and/or for mounting a trim member similar in design to interior trim 220.

An adapter 210 may be provided to retain, for example, panel 260 having a thickness smaller than that of panel 261. Adapter 210 may include a notch 211, identical to notches 57 on rail 50, extending along the length thereof so as to provide an insertion area for retainer 251. A protrusion 212 may also be provided on adapter 210 for insertion into notch 194 on second corner-rail 190, and likewise in notch 57 on rail 50 (see FIG. 12). It should be apparent that the length of adapter 210 may be dimensioned to accommodate, for example, panels of different thickness.

Referring still to FIG. 11, interior trim 220 may include flat surfaces 221, 222 and 223. Alternatively, interior trim 220 may include curved, notched, or other such surfaces, as would be apparent to a skilled artisan. Surface 221 may be partially finished to engage, for example, a ceiling 230, of a building, or be spaced from ceiling 230, as shown in FIG. 11. Interior trim 220 may further include first and second engagement sections 224 and 225. Engagement section 224 may include flat retention tongues 226, and engagement section 225 may include mirror-image enlarged retention tongues 227 for retention of interior trim 220 against retention member 130. Alternatively, it should be apparent that engagement sections 224 and 225 may include at least one flat or enlarged retention tongue, or any combination thereof.

As shown in FIG. 11, exterior trim 240, similar to exterior trim 70 described above, may be mounted onto protrusions 182 on first top rail 180. Exterior trim 240 may include engagement sections 241 and 242 of different lengths. For example, engagement section 241 may have a length smaller than that of engagement section 242, so as to provide a clearance between exterior trim 240 and ceiling 230. Alternatively, it should be apparent that engagement sections 241 and 242 may be of equal length, or may be manufactured in various other sizes as necessary.

Top-most section of curtain wall 30 may further include retainers 250 and 251 for retention, for example, of a panel 260. Retainers 250 and 251 may be conventional retainers that may be inserted into notches 183 and 194 so as to resiliently and frictionally retain panel 260 in curtain wall 30. Referring to FIG. 8, retainer 250 may include an insertion tip 252 and an engagement edge 253. Likewise, retainer 251 may include an insertion tip 254 and an engagement edge 255.

Referring next to FIG. 12, an exemplary center-most section of curtain wall 30 will now be described in detail. For the following description, the center-most section of curtain wall 30 generally refers to locations A2 in the illustrative curtain wall shown in FIG. 7.

Center-most section of curtain wall 30 may include rail 50, as described above.

Center-most section of curtain wall 30 may further include a bead 270 to facilitate assembly of exterior trim 100 on rail 50. Bead 270 may include a curved protrusion 271 and an extension 272 to engage catch 54 and abutment surface 55, respectively, of rail 50. Bead 270 may further include a protrusion 273, extending substantially along the entire length thereof, for connection of exterior trim 100 thereto. Protrusion 273 may be identical to protrusion 39, described above, for mullion 31. Bead 270 may also include a notch 274 identical to notches 43 on mullion 31, extending along the length thereof so as to provide an insertion area for retainer 251 for retaining, for example, panel 261.

Referring to FIG. 12, adapter 210, described above, may be used to retain, for example, panel 260 having a thickness smaller than that of panel 261. Retainer 251 may be inserted into notch 211 on adapter 210, and protrusion 212 may be inserted into notch 57 on rail 50.

Center-most section of curtain wall 30 may include panels 260 or 261, or panels of various other thickness, above or below rail 50.

Figure 13:
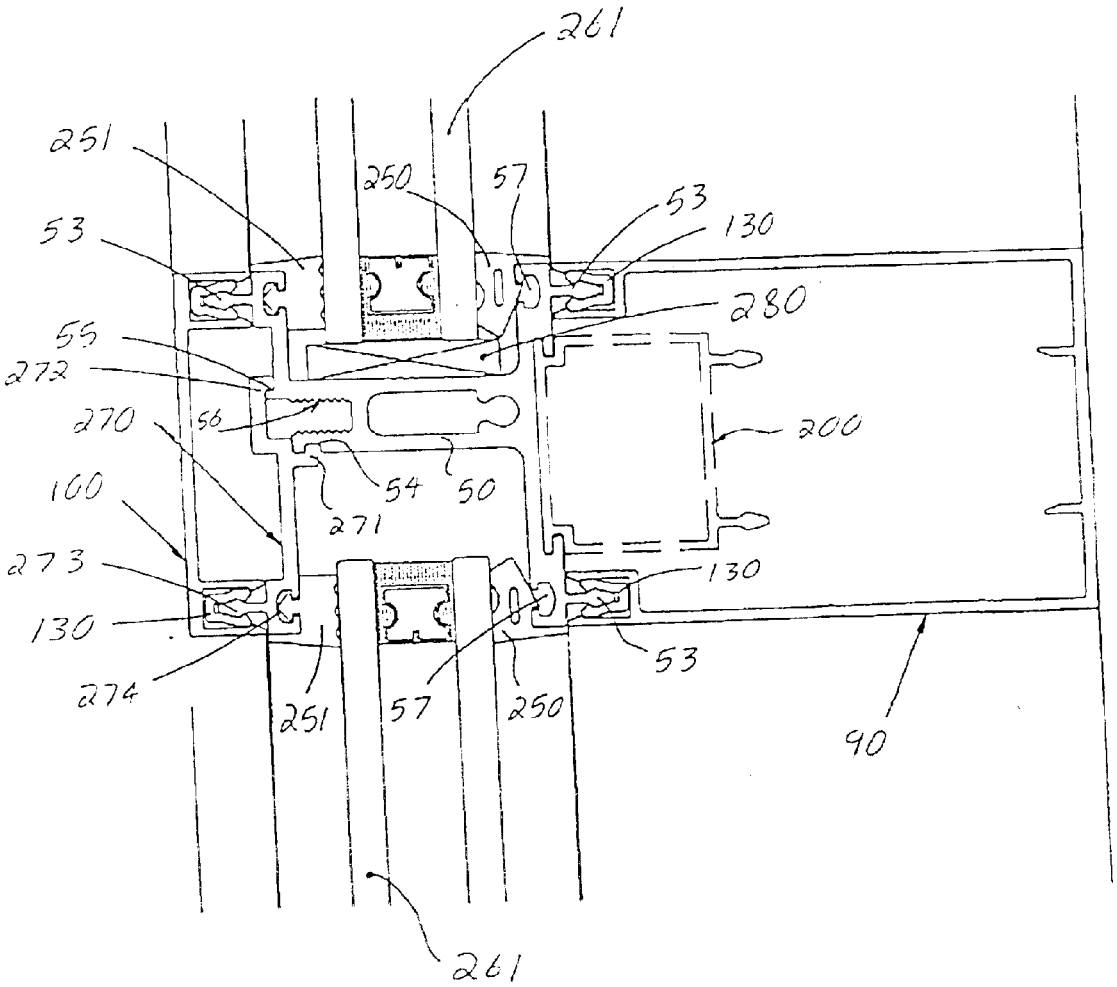
FIG. 13 is a sectional top view of an exemplary center-most section of a curtain wall, illustrating panels of the same thickness and the components in an assembled configuration.

For example, in the embodiment shown in FIG. 13, for panels of equal thickness (i.e. two panels 261), adapter 210 may be excluded from the framework of curtain wall 30 altogether (as compared to the embodiment of FIG. 12).

Figure 14:
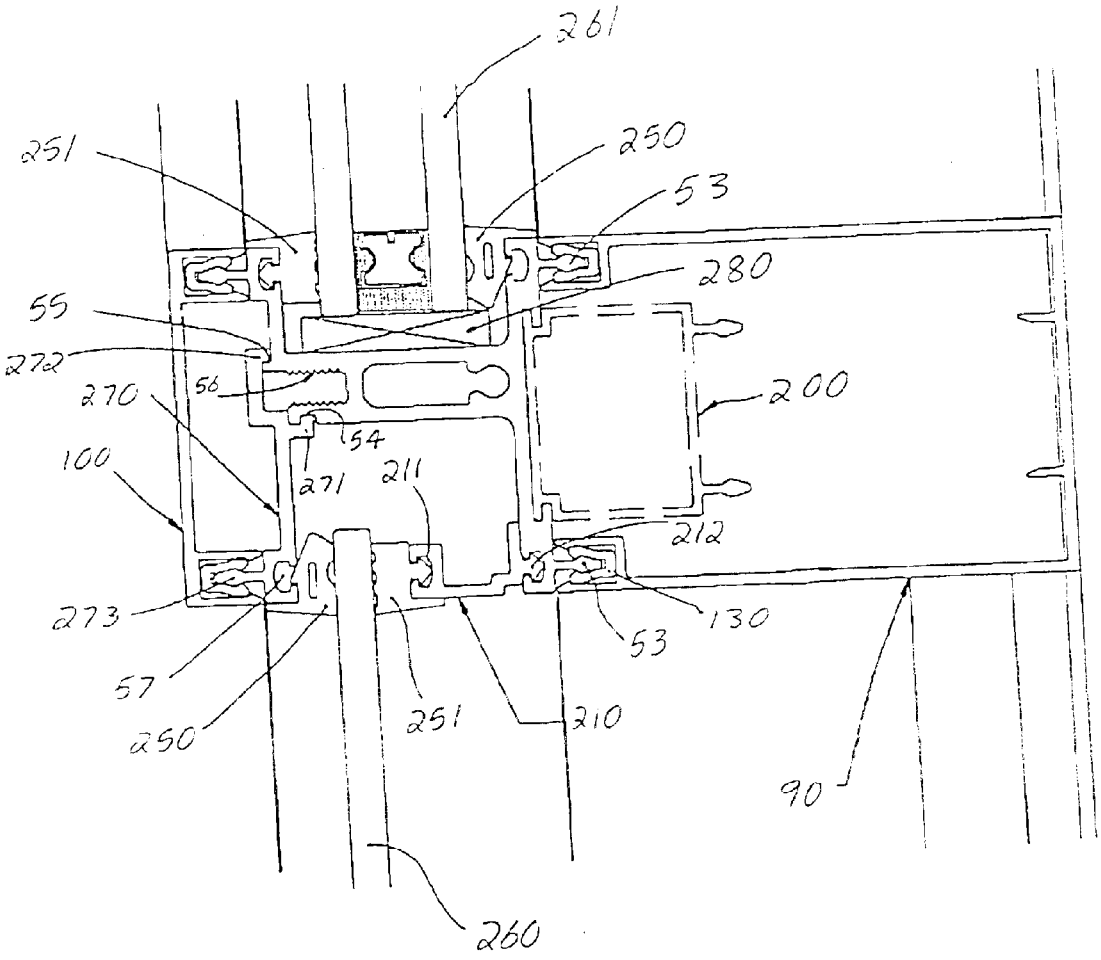
FIG. 14 is a sectional top view of an exemplary center-most section of a curtain wall, illustrating panels of different thickness arranged opposite from the arrangement of FIG. 12 and the components in an assembled configuration.

Additionally, in the embodiment shown in FIG. 14, for panels of different thickness (i.e. panels 260 and 261), adapter 210 may be mounted on the lower section of rail 50 (as opposed to the upper section for FIG. 12).

Figure 15:
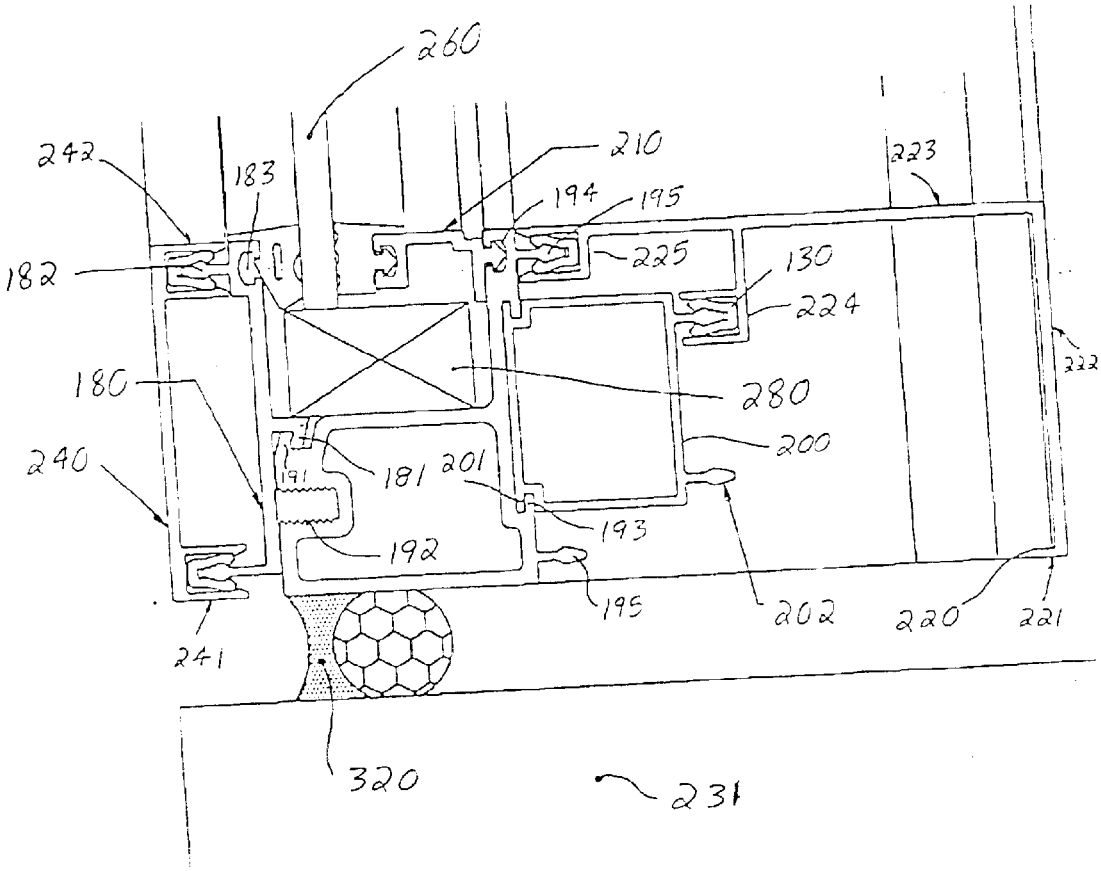
FIG. 15 is a sectional top view of an exemplary bottom-most section of a curtain wall, illustrating the components in an assembled configuration.

Referring next to FIG. 15, the bottom-most section of curtain wall 30 will now be described in detail. For the following description, bottom-most section of curtain wall 30 generally refers to location A3 in the illustrative curtain wall shown in FIG. 7.

The bottom-most section of curtain wall 30 may include first corner-rail 180, second corner-rail 190, third corner-rail 200, adapter 210, interior and exterior trim 220 and 240, respectively, and retainers 250 and 251, each described above and mounted to floor 231, inverted from the orientation shown in FIG. 11.

As shown in FIGS. 13–15, panels 260 or 261, when resting on rail 50, may be positioned on a spacer 280. Spacer 280 may be a conventional spacer and may be made of plastic, rubber, or any other conventional material, as would be apparent to a skilled artisan. Moreover, spacer 280 may be made of various configurations, as shown for example in the thicker configuration shown in FIG. 15, as compared to the configuration of FIG. 11.

Figure 16:
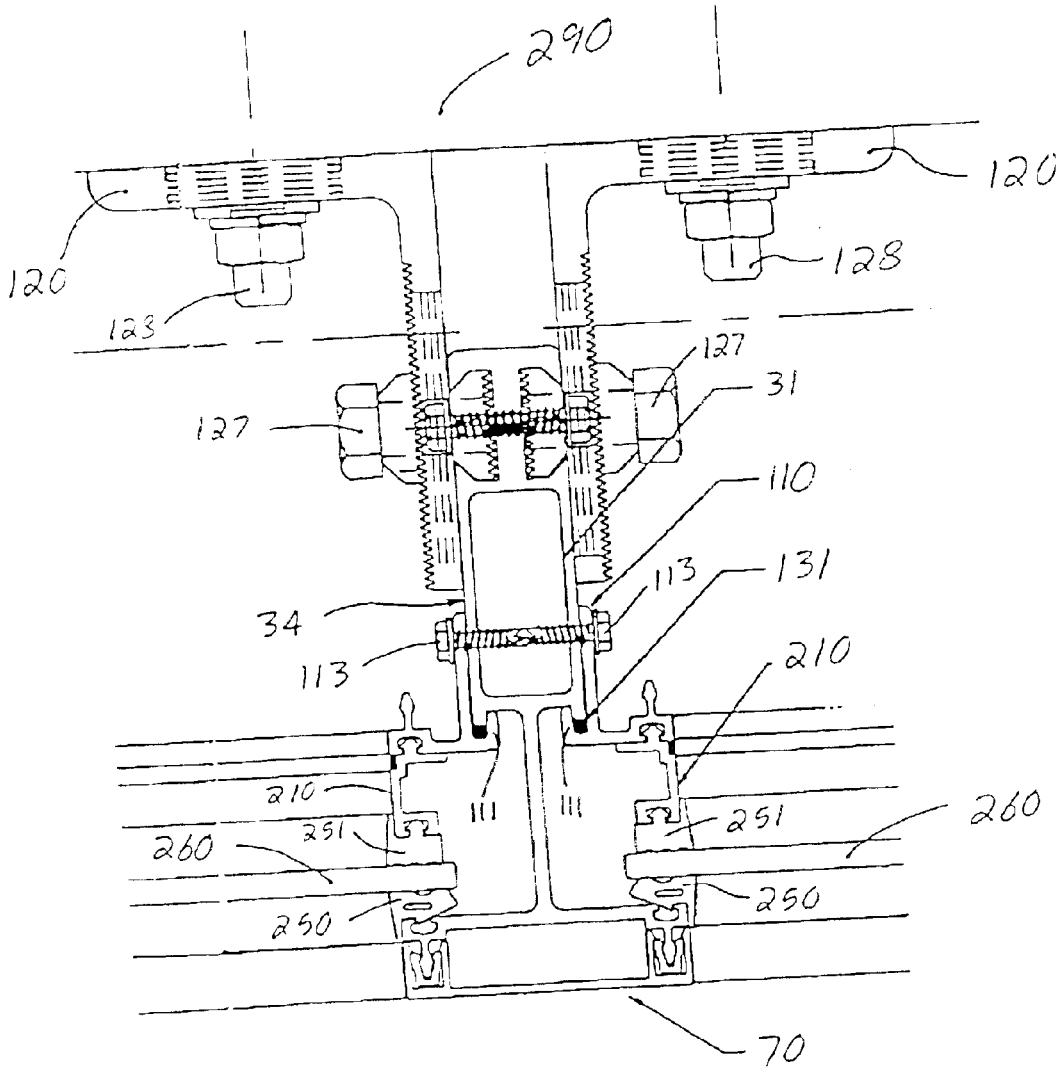
FIG. 16 is a sectional top view of an assembly including the mullion and two rails of FIG. 1, the assembly mounted to a wall by two anchors.

Referring next to FIG. 16, mullion 31 is shown anchored, for example, to a wall 290 of a building by two anchors 120 adjacent each side wall 34 of mullion 31. For attachment by two anchors 120, each of the components described above for the attachment of anchor 120 for FIG. 5, are used in a mirror-image configuration for each side wall 34 of mullion 31. Likewise, each of the components described above for the attachment of bead 110 and rail 50, may be used in a mirror-image configuration for each side wall 34 of mullion 31.

Figure 17:
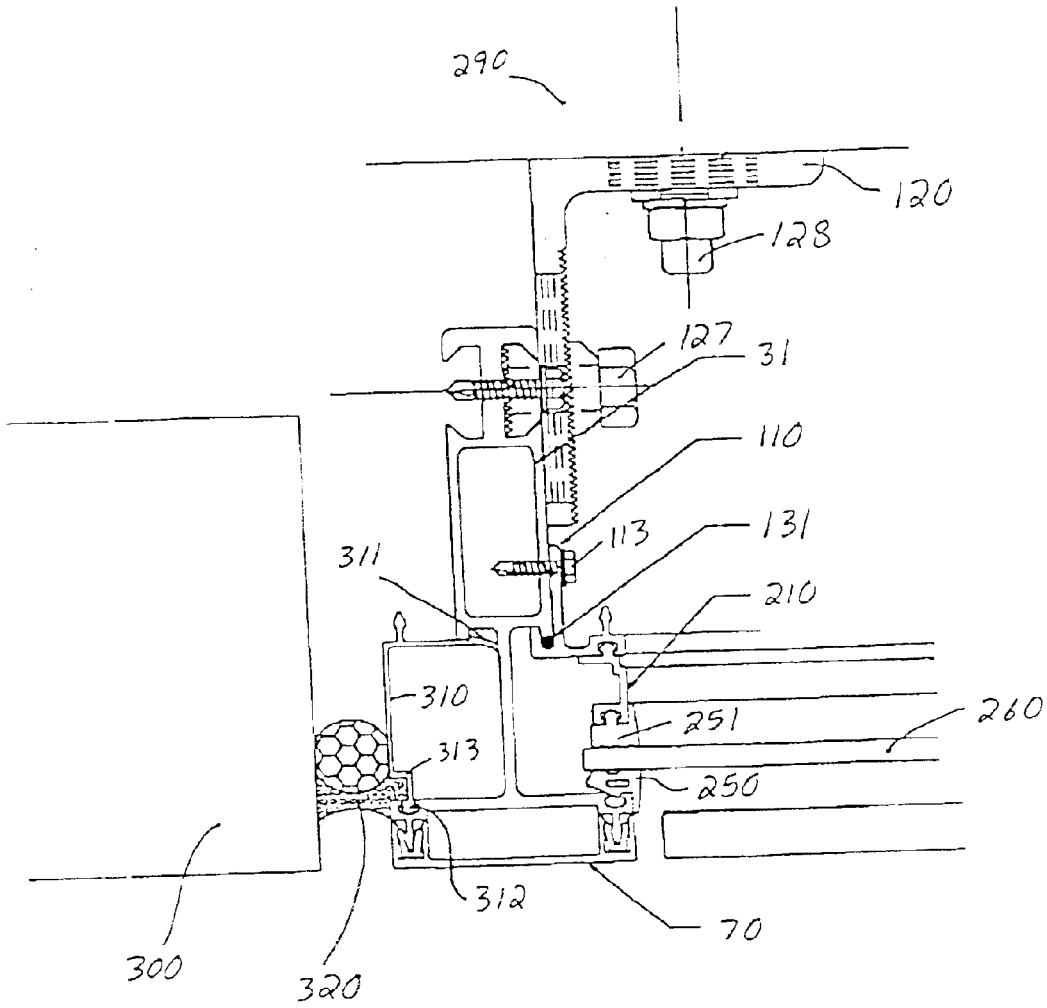
FIG. 17 is a sectional top view of an assembly including the mullion and rail of FIG. 1, the assembly mounted to a wall by one anchor and sealed relative to an orthogonal wall.

Referring next to FIG. 17, mullion 31 is shown anchored, for example, to wall 290 of a building by a single anchor 120 attached to one of the side walls 34 of mullion 31. Moreover, in the configurations of FIGS. 9 and 17, a rail 310 may be attached to mullion 31 and sealed conventionally by seal 320 between curtain wall 30 and wall 300. Rail 310 may include catch 311 for a snap-fit attachment to ridge 38 of mullion 31. Rail 310 may further include a protrusion 312 for insertion into notch 43 on mullion 31, and a bent section 313 to allow seal 320 to seal any gaps between curtain wall 30 and wall 300.

Figures 18, 19:
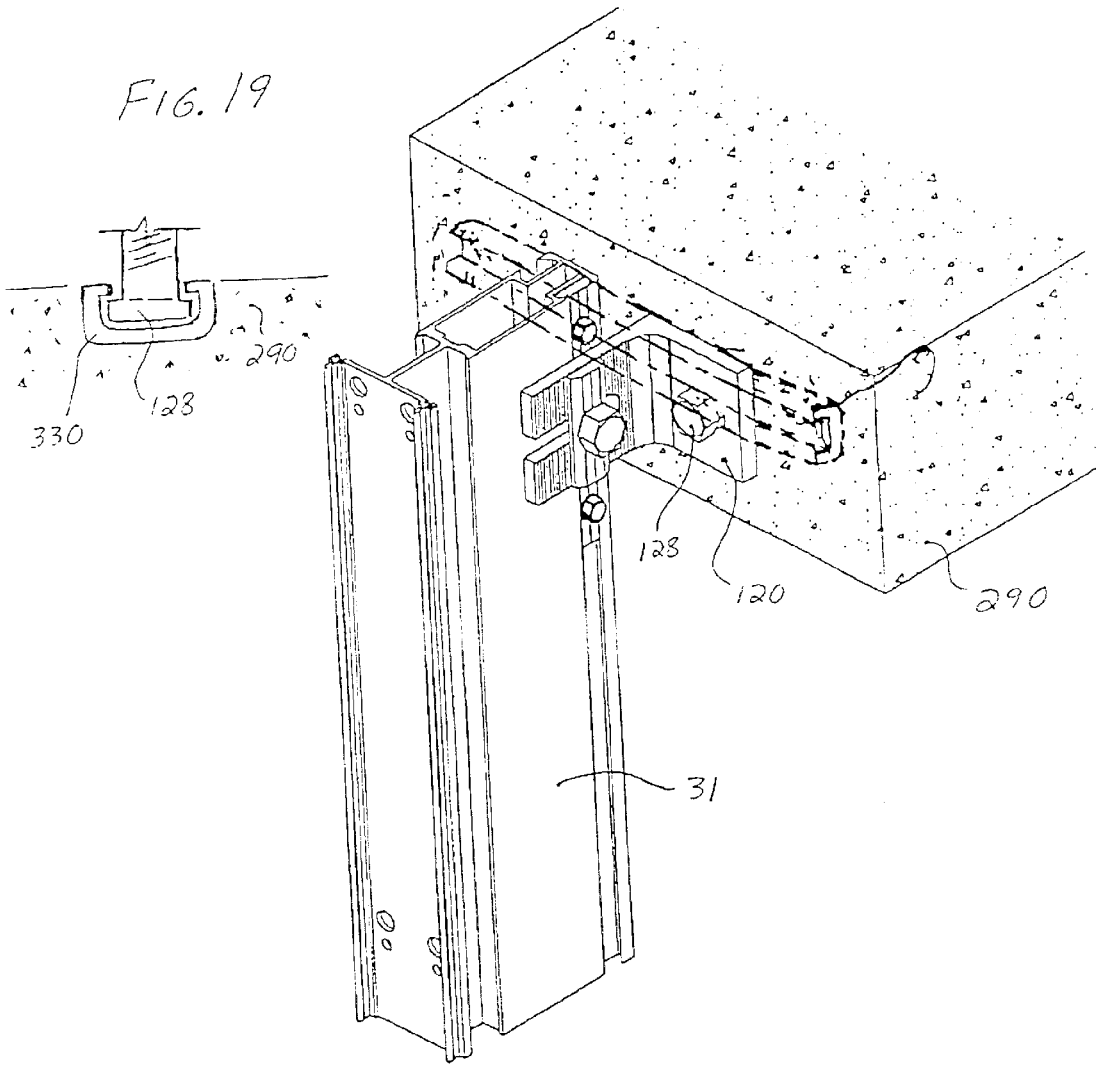
FIG. 18 is a perspective view of an assembly including the mullion and rail of FIG. 1, the assembly mounted to a wall by one anchor, illustrating a coupler for mounting the anchor to the wall by a bolt.
FIG. 19 is a sectional front view of the coupler of FIG. 18, illustrating the head of a bolt mounted therein.

Referring next to FIGS. 18 and 19, as described above, mullion 31 may be attached, for example, to wall 290 by means of anchor 120. Nut-bolt assembly 128 may be used to attach anchor 120 to wall 290 by sliding the head of the bolt for assembly 128 into an elongated coupler 330 and thereafter tightening the nut for assembly 128.

Referring to FIGS. 1–19, each of the components of curtain wall 30, discussed above, may be manufactured by methods such as casting, stamping, injection molding and the like, as would be apparent to a skilled artisan. Each of components of curtain wall 30, discussed above, may be milled, sanded or likewise manufactured for a smooth or coarse surface finish. Each of the components of curtain wall 30, discussed above, may be made of a plastic, ceramic, metal and other such equivalent material, as would be apparent to a skilled artisan. Moreover, it should be noted that although FIGS. 1–19 show orthogonal connections between the various components of curtain wall 30, it should be obvious that angular connections may also be used for the connections between the various components, as would be within the level of skill of an ordinary artisan.

The assembly and installation of curtain wall 30 will now be described in detail.

In order to assemble curtain wall 30, as shown in FIG. 1, rail 50 may be inserted into mullion glazing pocket 36 of mullion 31 and attached to mullion 31 by screw 42. Likewise, as shown in FIGS. 6, 8–10, 12–14 and 16, additional rails 50 may be attached to mullion 31 as necessary for supporting glazing infill components, such as panels, doors, windows and the like. Upon assembly of rail(s) 50 to mullion 31, mullion glazing pockets 36 may be sealed by seal 80 to seal any gaps between rail(s) 50 and mullion 31. Next, beads 110, shown for example in FIGS. 4, 8, 9 and 16, may be attached to one or both side walls 34 of mullion 31 by screws 113. Likewise, for the center-most sections of curtain wall 30, bead 270, shown for example in FIGS. 12–14, may be attached to rail 50 and fixedly mounted to rail 50 by screw 58 engaged in threaded section 56. For the top-most and bottom-most sections of curtain wall 30, shown for example in FIGS. 11 and 15, first corner-rail 180 may be fixedly mounted to second corner-rail 190 by a screw (not shown) engaged in threaded section 192 of second corner-rail 190. Thereafter, third corner-rail 200 may be attached to second corner-rail 190.

Next, the top and bottom-most sections of curtain wall 30 may be anchored to the wall of a building by anchor 120 of FIG. 5, shown in the assembled configurations of FIGS. 16–18. Specifically, second guide 125 may first be adjusted as necessary in passageway 45 of mullion 31. Thereafter, screws 126 may be used to lock second guide 125 in a fixed position, and anchor 120 may be mounted to mullion 31 by bolt 127 and first guide 124. For the configuration of FIG. 16, a second anchor 120 may be similarly mounted to mullion 31. Next, the frame structure of FIGS. 16–18 may be attached to the wall of a building by bolts 128, whose head may first be anchored in a wall within coupler 330.

After attachment of the curtain wall 30 frame to a wall, as shown in FIGS. 6, 8, 9 and 11–17, glazing infill components, such as panels, doors, windows and the like, may be oriented and adjusted within the framework by spacers 280 (if necessary) and retained in the framework by retainers 250 and 251. If necessary, as shown for example in FIGS. 11, 14 and 15, adapter(s) 210 may be used with retainers 250 and 251, to retain relatively thin glazing infill components (i.e. panel 260).

For the exposed sections of mullion 31, retention members 130 may be placed onto protrusions 39 of mullion 31, and likewise onto protrusions 53 of rail 50. Thereafter, as shown in FIG. 6, interior trim 60, 90 and 93, and exterior trim 70 and 100, may be mounted onto the protrusions as necessary.

For top-most and bottom-most sections of curtain wall 30 shown in FIGS. 11 and 15, respectively, retention members 130 may be placed onto protrusions 182, 195 and 202 of first, second and third corner-rails 180, 190 and 200, respectively. Exterior and interior trim 240 and 220, respectively, may then be mounted onto the protrusions as necessary.

After installation of curtain wall 30, any gaps between the curtain wall 30 and any adjacent walls of a building may be sealed by a conventional seal 320, as shown for example in FIGS. 11, 15 and 17.

In order to remove and replace any of the glazing infill components, retainers 250 and 251 may be removed from either side of curtain wall 30 and the components may be replaced as necessary. Accordingly, for the various embodiments of the components of curtain wall 30 described above, it should be evident that any of the glazing infill components, such as panels, doors, windows and the like, may be installed from either the inside or outside of curtain wall 30, at the discretion of the installer. Such installation may be performed without altering any of the above-described components. Moreover, after installation, barring any external physical constraints, any of the glazing infill components may be replaced from either side of curtain wall 30.

It should be apparent that the assembly method described above is only exemplary, and many other variations of the described method may be used to assemble and install curtain wall 30, as would be apparent to a skilled artisan.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A curtain wall having a front side and a back side, said curtain wall comprising:

at least one mullion comprising at least one glazing pocket, an I-section for supporting a first trim member and at least one protrusion for supporting a second trim member;

at least one first rail having a width greater than a width of said at least one glazing pocket, comprising at least one notch for insertion into said at least one glazing pocket and at least one protrusion for supporting third and fourth trim members;

at least one bead comprising at least one protrusion thereon, connected to said at least one mullion in a lengthwise direction thereof; and supporting said first trim member;

at least one first retainer for removably retaining a glazing infill component against one said at least one mullion, each said at least one first retainer insertable into a notch in said at least one mullion; and at least one second retainer for removably retaining said glazing infill component against one said at least one bead, each said at least one second retainer insertable into a notch in said at least one bead, wherein said glazing infill component may be installed from either said front side or said back side of said curtain wall.

2. The curtain wall according to claim 1, wherein said at least one glazing pocket, said I-section, and at least one notch and said at least one protrusion on said at least one mullion extend substantially along a length of said at least one mullion, said at least one protrusion on said at least one first rail extend substantially along a length of said at least one first rail, and said at least one notch and said at least one protrusion on said at least one bead extend substantially along a length of said at least one bead.

3. The curtain wall according to claim 1, wherein said at least one mullion further comprises a hollow section having first and second walls, adjacent said I-section and extending substantially along a length of said at least one mullion.

4. The curtain wall according to claim 1, wherein said at least one mullion further comprises at least one ridge for engaging said at least one bead.

5. The curtain wall according to claim 1, further comprising a seal for sealing an area between edges of said at least one first rail substantially adjacent said at least one mullion.

6. The curtain wall according to claim 1, wherein said first trim member comprises at least one extension for contiguously engaging at least one surface on said I-section.

7. The curtain wall according to claim 1, wherein said first trim member comprises at least one engagement section having at least one retention tongue for removably connecting said first trim member to said at least one protrusion on said at least one bead.

8. The curtain wall according to claim 1, wherein said second trim member comprises at least one engagement section having at least one retention tongue for removably connecting said second trim member to said at least one protrusion on said at least one mullion.

9. The curtain wall according to claim 1, wherein said at least one protrusion on said at least one mullion comprises a narrow shaft section and an enlarged head section.

10. A curtain wall having a front side and a back side, said curtain wall comprising:

at least one mullion comprising at least one glazing pocket, an I-section for supporting a first trim member and at least one protrusion for supporting a second trim member;

at least one first rail having a width greater than a width of said at least one glazing pocket, comprising at least one notch for insertion into said at least one glazing pocket and at least one protrusion for supporting third and fourth trim members;

at least one bead comprising at least one protrusion thereon, connected to said at least one mullion in a lengthwise direction thereof, and supporting said first trim member;

at least one first retainer for removably retaining a glazing infill component against one said at least one mullion, each said at least one first retainer insertable into a notch in said at least one mullion;

at least one second retainer for removably retaining said glazing infill component against one said at least one bead, each said at least one second retainer insertable into a notch in said at least one bead; and at least one retention member disposed on at least one said at least one protrusion on said at least one mullion, said at least one first rail and said at least one bead, wherein said glazing infill component may be installed from either said front side or said back side of said curtain wall.

11. The curtain wall according to claim 1, wherein said at least one first rail is mounted substantially orthogonal to said at least one mullion.

12. The curtain wall according to claim 1, wherein said at least one first rail is mounted at an angle to said at least one mullion.

13. The curtain wall according to claim 1, further comprising at least one third retainer for removably retaining said glazing infill component against one said at least one first rail, each said at least one third retainer insertable into a notch in said at least one first rail.

14. The curtain wall according to claim 1, wherein said at least one first rail is mounted to said at least one mullion by at least one screw.

15. The curtain wall according to claim 1, wherein said third trim member comprises at least one engagement section having at least one retention tongue for removably connecting said third trim member to said at least one protrusion on said at least one first rail.

16. The curtain wall according to claim 1, wherein said fourth trim member comprises at least one engagement section having at least one retention tongue for removably connecting said fourth trim member to said at least one protrusion on said at least one first rail.

17. The curtain wall according to claim 1, further comprising at least one other bead connected to said at least one first rail, in a lengthwise direction thereof, and having at least one protrusion for supporting said fourth trim member.

18. The curtain wall according to claim 17, wherein said at least one other bead is connectable to said at least one first rail by insertion of a protrusion on said at least one other bead into a catch on said at least one first rail.

19. The curtain wall according to claim 17, wherein said at least one first rail includes at least one threaded section for removably connecting said at least one other bead to said at least one first rail by a threaded fastener.

20. A curtain wall having a front side and a back side, said curtain wall comprising:

at least one mullion comprising at least one glazing pocket, an I-section for supporting a first trim member and at least one protrusion for supporting a second trim member;

at least one first rail having a width greater than a width of said at least one glazing pocket, comprising at least one notch for insertion into said at least one glazing pocket and at least one protrusion for supporting third and fourth trim members;

at least one bead comprising at least one protrusion thereon, connected to said at least one mullion in a lengthwise direction thereof, and supporting said first trim member;

at least one first retainer for removably retaining a glazing infill component against one said at least one mullion, each said at least one first retainer insertable into a notch in said at least one mullion;

at least one second retainer for removably retaining said glazing infill component against one said at least one bead, each said at least one second retainer insertable into a notch in said at least one bead; and at least one anchor adjustably mountable along a length of said at least one mullion, wherein said glazing infill component may be installed from either said front side or said back side of said curtain wall.

21. The curtain wall according to claim 20, wherein said at least one anchor is adjustably mountable by a first guide which is slidably adjustable along a length of said at least one mullion and fixable adjacent said I-section.

22. The curtain wall according to claim 20, wherein said at least one anchor further comprises a first slot for permitting adjustment of said anchor in a direction orthogonal to a first surface on said at least one mullion and a second slot for permitting adjustment of said anchor in a direction orthogonal to a second surface on said at least one mullion, said first surface disposed substantially orthogonal to said second surface.

23. The curtain wall according to claim 21, wherein said at least one anchor further comprises a second guide for mounting said at least one anchor to said first guide.

24. The curtain wall according to claim 20, wherein said at least one anchor is mountable to a wall in a building by a bolt whose head is insertable into and slidable along a coupler pre-installed in the wall of the building.

25. The curtain wall according to claim 4, further comprising at least one second rail including at least one protrusion extending along a length thereof, and a catch engageable with said at least one ridge.

26. The curtain wall according to claim 13, further comprising at least one adapter including a protrusion and a notch, each extending along a length thereof, said protrusion being insertable into said notch in said at least one first rail, and said third retainer being insertable into said notch in said at least one adapter.

27. The curtain wall according to claim 1, wherein said at least one mullion, said at least one first rail, said at least one bead, and said first, second, third and fourth trim members are made of plastic, ceramic or metal.

28. The curtain wall according to claim 10, wherein said at least one retention member is made of plastic, ceramic or metal.

29. The curtain wall according to claim 17, wherein said at least one other bead is made of plastic, ceramic or metal.

30. The curtain wall according to claim 20, wherein said at least one anchor is made of plastic, ceramic or metal.

31. The curtain wall according to claim 25, wherein said at least one second rail is made of plastic, ceramic or metal.

32. The curtain wall according to claim 26, wherein said at least one adapter is made of plastic, ceramic or metal.

33. The curtain wall according to claim 13, further comprising:

at least one first corner-rail comprising at least one protrusion for supporting a fifth trim member, at least one notch for insertion of a fourth retainer, and an angled retainer;

at least one second corner-rail comprising a complementary angled retainer for engaging said angled retainer on said at least one first corner-rail, at least one protrusion for supporting a sixth trim member, at least one notch for insertion of a protrusion on an adapter having a protrusion and a notch, and at least one extension; and at least one third corner-rail comprising at least one complementary extension for engagement with said at least one extension on said at least one second corner-rail, and at least one protrusion for supporting said sixth trim member.

34. The curtain wall according to claim 33, wherein said at least one second corner-rail further comprises at least one threaded section for removably connecting said at least one first corner-rail to said at least one second corner-rail by a threaded fastener.

35. The curtain wall according to claim 33, wherein said fifth trim member comprises at least one engagement section having at least one retention tongue for removably connecting said fifth trim member to said at least one protrusion on said at least one first corner-rail.

36. The curtain wall according to claim 33, wherein said sixth trim member comprises at least one engagement section having at least one retention tongue for removably connecting said sixth trim member to said at least one protrusion on said at least one second corner-rail and said at least one third corner-rail.

37. The curtain wall according to claim 33, wherein said at least one first corner-rail, said at least one second corner-rail and said at least one third corner-rail are made of plastic, ceramic or metal.

* * * * *